United States Patent [19]

La Rose

[11] 4,063,739

[45] Dec. 20, 1977

[54] GOLF WARM UP NET

[76] Inventor: Wally La Rose, 1223 W. H St., Oakdale, Calif. 95361

[21] Appl. No.: 762,885

[22] Filed: Jan. 27, 1977

[51] Int. Cl.[2] ..... A63B 69/36

[52] U.S. Cl. ..... 273/181 F; 273/102 S; 273/29 BB

[58] Field of Search ..... 273/29 B, 29 BB, 181 R, 273/181 F, 181 J, 105 R, 105 A, 102 S, 102.4

[56] References Cited

U.S. PATENT DOCUMENTS

| | | | |
|---|---|---|---|
| 574,087 | 12/1896 | Frick | 273/102 S |
| 1,262,314 | 4/1918 | Downey | 273/181 R |
| 1,437,591 | 12/1922 | Gray | 273/181 F X |
| 2,201,865 | 5/1940 | Kriekard | 273/105 R |
| 3,558,140 | 1/1971 | Romeo | 273/105 R |
| 3,918,711 | 11/1975 | Zak | 273/181 F X |
| 3,986,719 | 10/1976 | Lee | 273/181 J X |

*Primary Examiner*—George J. Marlo

[57] ABSTRACT

A golf practice net including a pair of upright posts having a top and bottom section pivotably connected to each other so that they can be folded for storage or transportation but which may be erected and inserted into the ground to support a net therebetween. The net is mounted in a frame having a sleeve connected to the top and bottom edges of the frame. The top sleeve includes a substantially U-shaped support whose legs are inserted in the top of each post to support the net between the posts. The bottom sleeve contains a plurality of weights retaining the net in a substantially upright position and to prevent undue movement of the net when struck with a golf ball.

6 Claims, 3 Drawing Figures

FIG.1
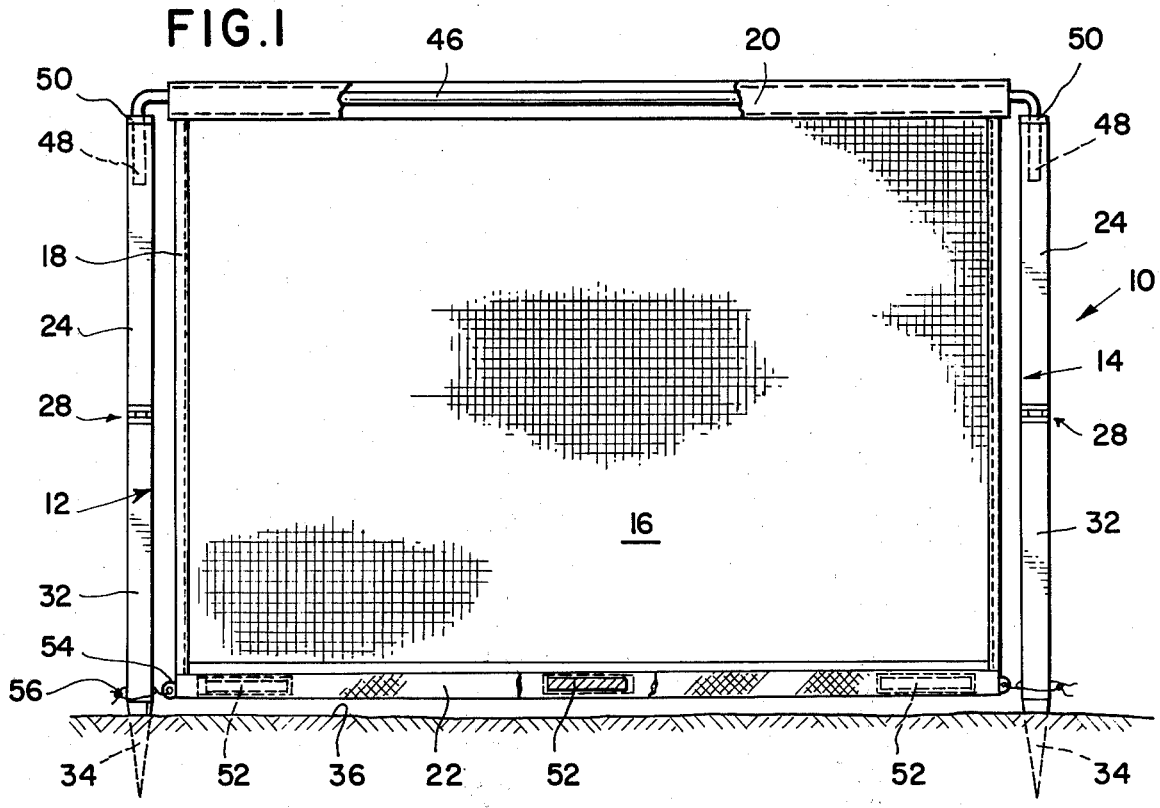
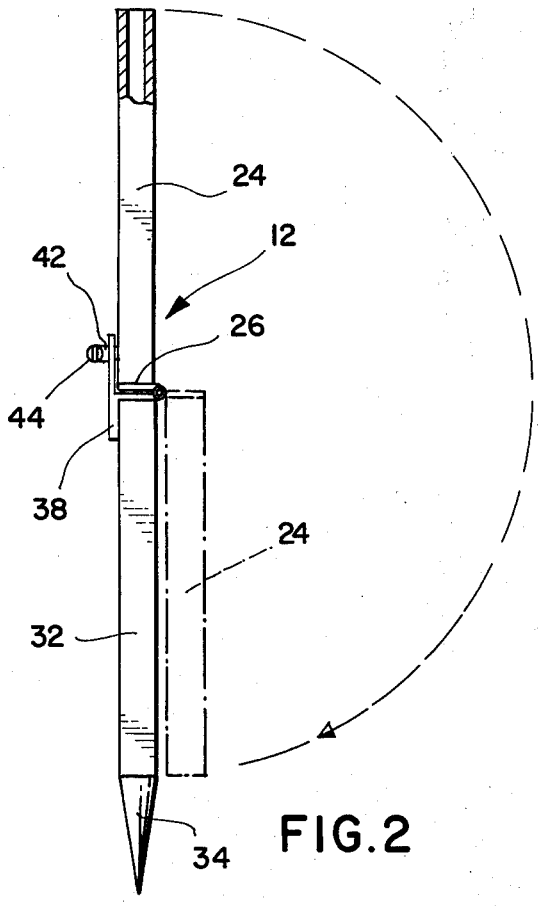
FIG.2
FIG.3
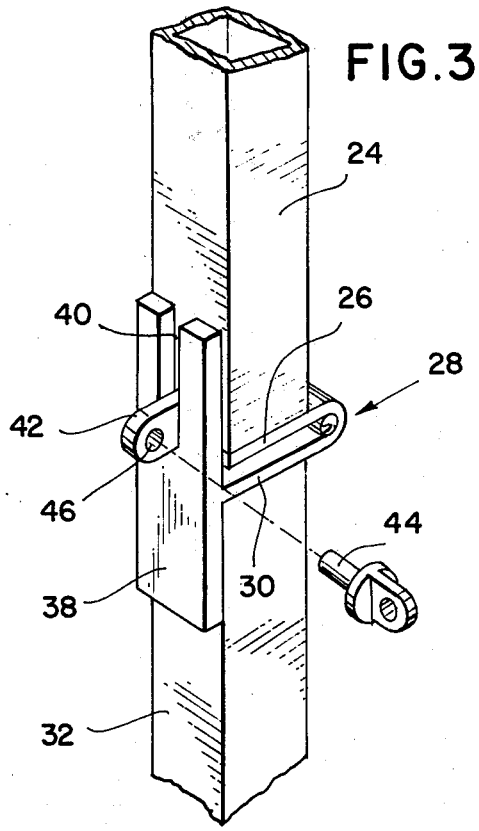

GOLF WARM UP NET

PRIOR ART

The following patents are considered pertinent:
U.S. Pat. No. 920,907
U.S. Pat. No. 1,405,081
U.S. Pat. No. 1,437,591
U.S. Pat. No. 1,566,945
U.S. Pat. No. 2,986,398
U.S. Pat. No. 3,001,795
U.S. Pat. No. 3,856,301

BACKGROUND OF THE INVENTION

This invention relates to a golf practice device, and more particularly, to a net construction adapted for use by a golfer in practicing golf shots to intercept a ball hit by the golfer to prevent it from traveling any substantial distance.

While backstops and practice nets are well known in the prior art, they lack sufficient portability on the whole to be carried about by the golfer to a convenient location wherein the golfer can practice after erecting the net. The net of the present invention is portable and can be knocked down to a convenient storage and carrying size.

SUMMARY OF THE INVENTION

In accordance with the invention, the practice net includes a pair of posts having pointed ends for insertion into the ground. Each post includes an upper and lower portion pivotably connected about a hinge having a portion connected to the top and bottom portion of each post so that the posts can be folded in half for convenience in storage and transportation. A separable net is mounted in a frame having a fabric envelope or sleeve connected to the top and bottom edges of the frame. The top sleeve mounts a tubular U-shaped connecting member whose end portions or legs are inserted within the top of each of the posts for supporting the net. The bottom sleeve contains a plurality of weights for holding the net in a substantially vertical, upright condition on the posts and prevents undue movement being imparted to the net when struck with a ball.

BRIEF DESCRIPTION OF THE DRAWING

Further objects and advantages of the invention will become apparent from the following description and claims, and from the accompanying drawing, wherein:

FIG. 1 is a front view in elevation, with portions broken away, of the golf warm up net of the present invention;

FIG. 2 is a side view in elevation of one of the supporting posts for the net of FIG. 1; and FIG. 3 is a perspective view of a portion of the post of FIG. 2.

DETAILED DESCRIPTION OF THE PREFERRED EMBODIMENT

Referring now to the drawing in detail, wherein like numerals indicate like elements throughout the several views, the golf warm up net 10 of the present invention includes a pair of posts 12 and 14 for supporting a net 16 mounted in a suitable frame 18 having a fabric sleeve 20 and 22 connected to the upper and lower edges of the frame 18.

Each of the posts includes an upper tubular portion 24 connected to the upper plate 26 of a hinge 28. The hinge 28 includes a lower plate 30 connected to the top of a lower post portion 32 which terminates in a pointed end 34 for insertion of each post into a ground surface 36.

The lower plate 30 of hinge 28 includes a substantially perpendicular plate 38 integrally connected thereto having an elongated slot 40 adjacent its upper end which receives a keeper plate 42 therethrough mounted on upper post portion 24. A pin 44 can be inserted within an opening 46 in keeper plate 42 to lock the upper portion 24 to the lower post 32 by preventing the keeper plate 42 from being removed from the slot 40 of plate 38. However, as shown in FIG. 2, with pin 44 removed the upper post portion 24 may be pivoted about hinge 28 to a position parallel to lower post portion 32 for convenience in handling the transportation and storage of each post 12 and 14, respectively.

The upper sleeve 20 connected to the net frame 18 has a U-shaped piece of tubing 46 inserted therethrough. The legs 48 of tubing 46 are inserted in the top of each upper post portion 24 of the posts 12 and 14 to mount the net 16 on the posts. A stop 50 can be provided on each leg 48 for supporting the legs on the posts.

The bottom sleeve 22 can have a plurality of weights 52 disposed therein to maintain the net 16 substantially in a vertical plane and prevent undue movement of net 16 when struck by a golf ball. Ears 54 may be provided on the opposite ends of sleeve 22 for receiving a tie 56 for further securing the bottom of the frame 18 of net 16 to reach post 12 and 14.

In use, with the net assembled as shown in FIG. 1, a golfer may drive golf balls against net 16 and quickly recover the balls. When not in use, the net may be removed from the top of the posts 12 and 14 and rolled into a convenient carrying position. Each of the post sections may be unlocked from each other and folded as shown in FIG. 2 for further ease of transportation or storage.

While a specific embodiment of a golf warm up net has been disclosed in the foregoing description, it will be understood that various modifications within the spirit of the invention may occur to those skilled in the art. Therefore, it is intended that no limitations be placed on the invention except as defined by the scope of the appended claims.

I claim:

1. A golf practice net comprising:

a pair of tubular posts, each post having a pointed end for insertion into the ground, a net mounted in a frame, a sleeve on the top and bottom edges of said net frame, U-shaped support means within the sleeve connected to the top edge of said net having legs adapted to be received within the top of each of said posts to support said net and frame in a substantial upright manner on said posts, and a plurality of weights disposed within the bottom sleeve of said net frame for maintaining said net in a substantially upright condition and preventing undue movement of said net when struck with a golf ball.

2. The net of claim 1 wherein each of the legs of said U-shaped support includes a stop plate mounted thereon for abutment with the top of each of said posts.

3. The net of claim 1 wherein each of said posts include a top and bottom section pivotably connected to each other.

4. The net of claim 3 wherein the top section of each of said posts includes a hinge plate mounted on the bottom thereof hingedly connected to a hinge plate mounted on the top of the bottom section thereof, and means for locking said hinge plates to each other to prevent relative movement thereof.

5. The net of claim 4 wherein said locking means includes a plate connected substantially perpendicular to the hinge plate connected to the top of the bottom section of each of said posts, a slot in the top of said plate, and a keeper element on the top section of each post slidably received within said slot.

6. The net of claim 5 wherein said keeper element includes an opening therethrough, and a locking pin received in said opening.

* * * * *